United States Patent [19]

Kenny

[11] 4,064,562

[45] Dec. 27, 1977

[54] INTEGRAL RAIN CAPE AND HAT

[76] Inventor: Bernice S. Kenny, 183 Eglantine Lane, Fort Myers Beach, Fla. 33931

[21] Appl. No.: 740,742

[22] Filed: Nov. 10, 1976

Related U.S. Application Data

[63] Continuation-in-part of Ser. No. 607,589, Oct. 20, 1975, abandoned.

[51] Int. Cl.[2] ..... A41D 9/00

[52] U.S. Cl. ..... 2/84

[58] Field of Search ..... 2/84–88

[56] References Cited

U.S. PATENT DOCUMENTS

| | | | |
|---|---|---|---|
| 1,592,562 | 7/1926 | Graham | 2/84 |
| 1,702,143 | 2/1929 | Weisz | 2/84 |

*Primary Examiner*—Doris L. Troutman

*Attorney, Agent, or Firm*—B. P. Fishburne, Jr.

[57] ABSTRACT

A garment particularly for rainy weather includes a cape body and a neck section rising from the upper margin of the cape body and being open at the front. The upper margin of the neck section extends into and is attached to the crown of the hat and also attached to the crown of the hat immediately inside of the neck section is a comparatively short strip of material having fastener elements adapted to coact with mating elements on the hat, whereby the cape body and neck section can be folded or rolled into a compact form within the crown of the hat and held in place within the crown by said short strip and fastener elements. The cape body is divided at its front and provided with fastener means. The garment can be made wholly or partly from sheet plastic material or from suitable water repellent fabric.

3 Claims, 7 Drawing Figures

INTEGRAL RAIN CAPE AND HAT

CROSS REFERENCE TO RELATED APPLICATION

This application is a continuation-in-part of prior copending application Ser. No. 607,589, filed Oct. 20, 1975 now abandon, for WEARING APPAREL.

BACKGROUND OF THE INVENTION

Hooded rain capes or like garments are broadly known in the prior art, and examples of the patented prior art are U.S. Pat. No. 2,971,198 of Feb. 14, 1961 and Norwegian Pat. No. 181,253 of Mar. 10, 1955.

The objective of this invention is to improve upon the known prior art by the provision of a garment for rainy weather which is more simplified and convenient to use, more attractive and less expensive than the prior art.

SUMMARY OF THE INVENTION

The invention comprises a unitized garment particularly for rainy weather including a cape body, a neck piece rising from the top of the cape body and being open at the front. The cape body is also divided at the front and provided with separable fasteners. The top of the neck piece or section is attached inside the crown of a hat which preferably includes a brim. A rolled garment enclosing and retaining strip divided preferably at the rear is also attached to the crown of the hat immediately inwardly of the neck piece. The attached strip and the hat have opposing self-gripping fastener elements.

DETAILED DESCRIPTION

Figure 1:
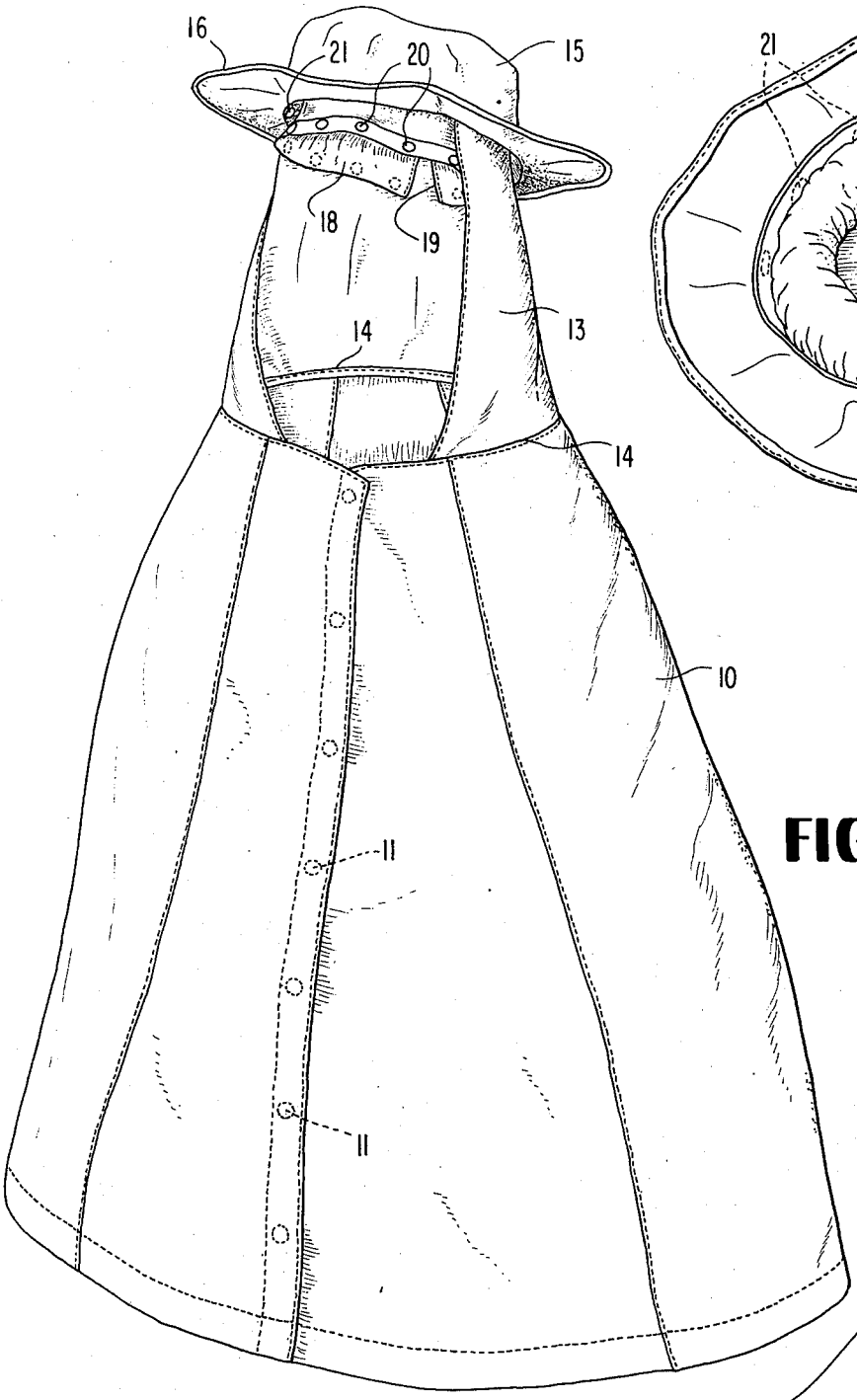
FIG. 1 is a perspective view of a rain garment embodying the invention with the component parts arranged for wear by a user.

Referring to the drawings in detail wherein like numerals designate like parts, the garment for rainy weather comprises a cape body 10 which is divided at the front and provided with a practical number of self-gripping or adhering fastener elements 11 and 12, preferably of the Velcro type. Other forms of separable fasteners can be employed, if preferred. The cape body 10 and the remainder of the garment may be formed of thin transparent waterproof plastic material or other suitable waterproof or water-repellent material including water-repellent fabric.

A neck section 13 is attached as at 14 to the top edge of cape body 10 and rises therefrom, as shown. The neck section 13 has a wide frontal opening to expose the face of the wearer and this opening is centered relative to the front closure means of the cape body 10.

Figure 4:
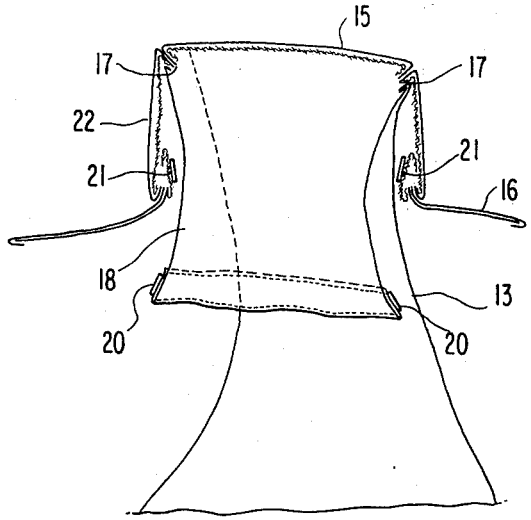
FIG. 4 is a central vertical front-to-back cross section through the garment as depicted in FIG. 1, partly broken away and partly in elevation.
Figure 7:
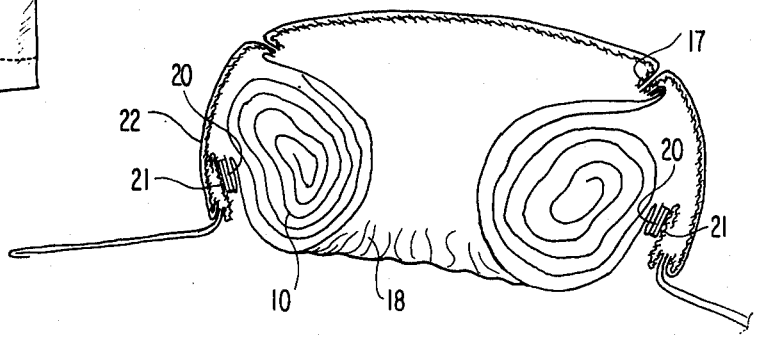
FIG. 7 is a fragmentary cross sectional view showing the garment completely folded or rolled into compact form and retained within the hat portion by a retaining strip on the hat portion and self-gripping fastener means.

The garment further includes an integral hat portion 15 of any preferred style preferably including a brim 16. The top margin of neck section 13 is attached permanently within the crown of the hat 15 at the top of the crown by stitching or the like as indicated at 17 in FIGS. 4 and 7. Immediately inwardly of the neck section 13, a comparatively short garment retaining and storing strip or skirt 18 is also to the crown of the hat at 17 around its entire margin. The retaining strip 18 is divided at its rear side as indicated at 19 to facilitate using the same for enclosing and retaining the rolled up or folded cape body and neck section in a compact stored form for ease of carrying when the garment is not in use.

The lower edge and outer surface of the retaining strip 18 carries a plurality of spaced fastener elements 20 of the type described at 11 and 12 for the cape body 10. A cooperating set of fastener components 21 is provided on the interior of the hat crown near and above the brim 16 in opposing relation to the elements 20 of the strip or skirt 18 and corresponding in number to the elements 20.

When the garment is used, the parts are extended as illustrated in FIG. 1, and the body, neck and head are protected from the weather. The element 18 can be left free-hanging, as shown, or if desired the self-gripping fastener elements 20 and 21 may be engaged.

Figure 2:
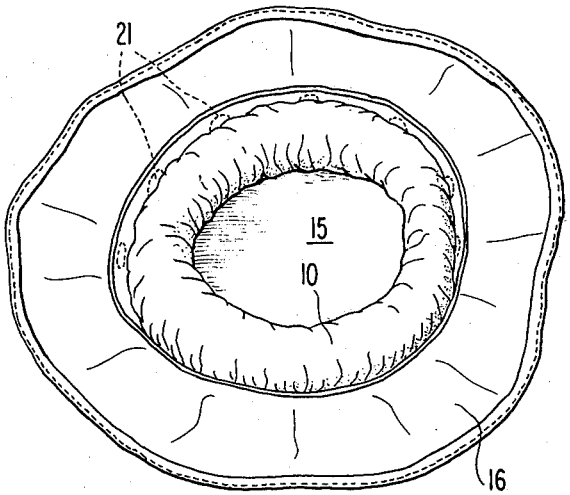
FIG. 2 is a perspective view of the garment in the stored or non-use condition with the body of the garment retained compactly inside of the hat portion.
Figure 3:
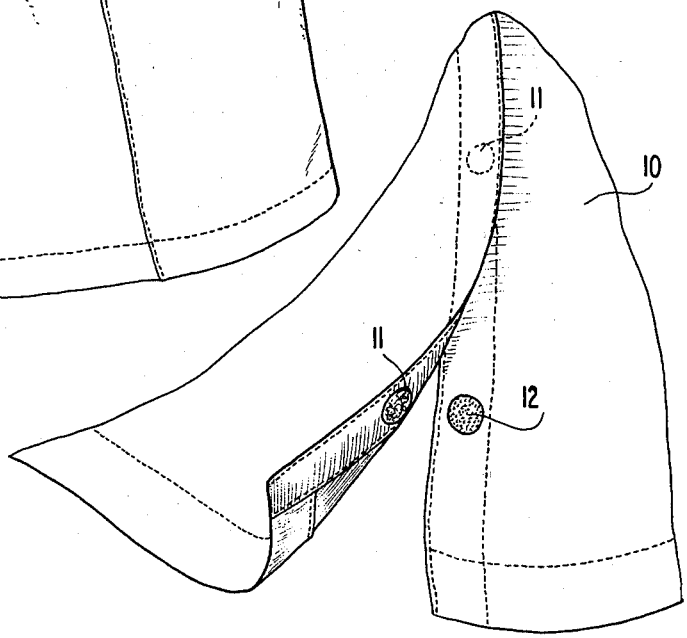
FIG. 3 is a fragmentary perspective view of self-gripping fasteners on the divided cape body.

When the garment is not in use, it can be arranged in extremely compact form, FIG. 2, for placement in a handbag or a bureau drawer, etc. In this form, the device can still be worn as a hat.

Figure 5:
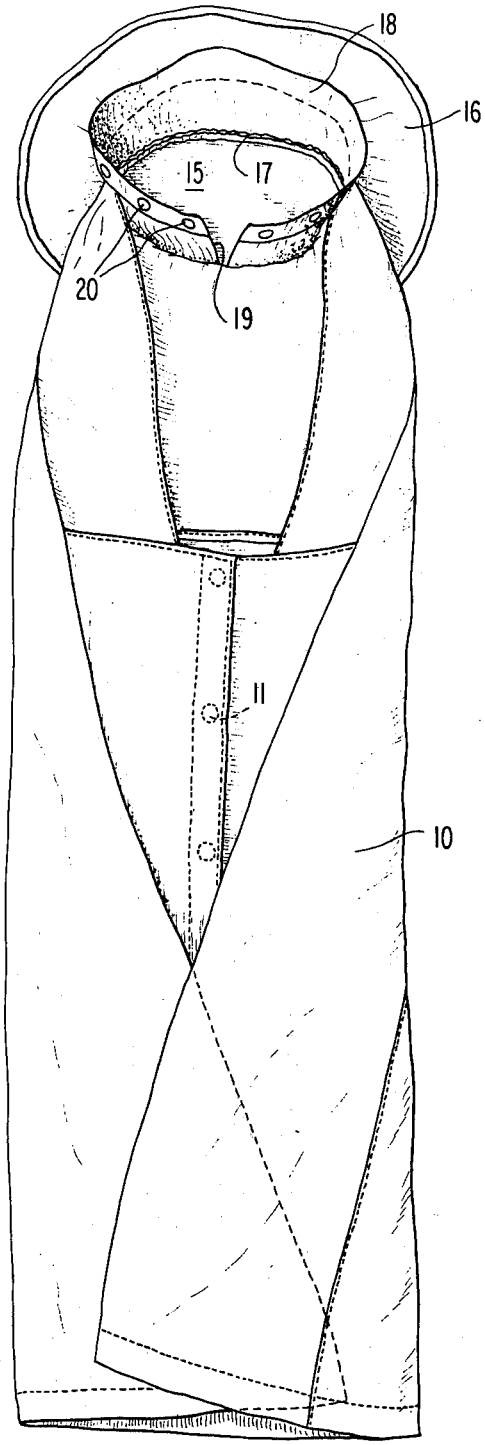
FIG. 5 is a front elevational view, partly in perspective, showing the preparation of the garment for storage in the hat portion.
Figure 6:
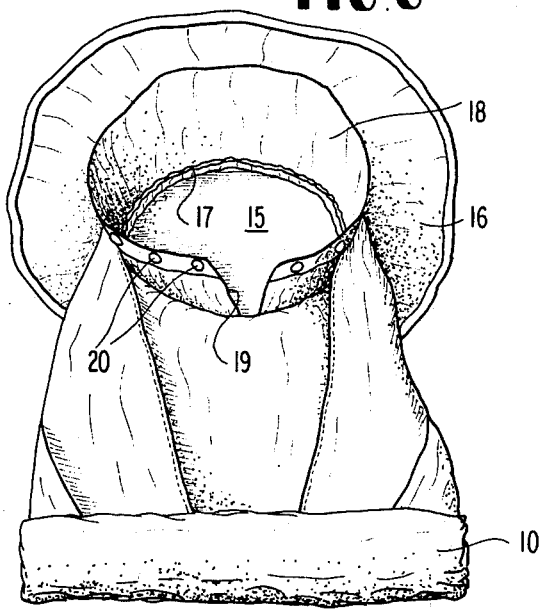
FIG. 6 is a further view like FIG. 5 showing further preparation of the garment for storage and retention in the hat portion.

In preparing the garment for storage, the body portion is arranged as in FIG. 5 in approximately rectangular form. The body portion is then rolled or folded upwardly in tight compact form toward the hat, as shown in FIG. 6 and, finally, the rolled body portion or cape 10 can be placed inside of the hat crown substantially in annular form, FIG. 2. The retaining strip 18 is then placed around the inner periphery of the tightly rolled garment body portion, FIG. 7, and the coacting fastener components 20 ad 21 are engaged between the side wall 22 of the hat crown and the outer periphery of the rolled cape or body portion. As clearly shown in FIG. 7, the retaining strip 18 secures the rolled garment body effectively inside of the hat crown where it will remain compactly held.

The advantages of the invention over the prior art should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A garment comprising a cape body, a neck section attached to and rising from the cape body and having a frontal opening, a hat section attached to the top of the neck section, a retaining skirt-like element attached to the hat section interiorly of both the hat section and the neck section, the hat section having a crown portion receiving, surrounding and at least partly enclosing the neck section and the skirt-like element when the latter are extended below the hat section, a first set of fastener components on the interior of the hat section, and a cooperating set of fastener components on the skirt-like element, whereby the entire cape body and neck section can be rolled into a compact form inside of the hat section and retained therein by engaging the fastener components of the skirt-like element with the fastener components of the hat section, the rolled cape body and neck section then being enclosed and held between the hat section and retaining skirt-like element.

2. A garment as defined in claim 1, and said cape body being divided at its front, and cooperating fastener components on the divided parts of the cape body to facilitate closing the cape body.

3. A garment as defined in claim 1, and said retaining skirt-like element being divided substantially at the rear of the garment and being of a length to extend somewhat below the hat section when freely hanging with the cape body and said neck section.

* * * * *